US009475172B2

(12) United States Patent
Cooksey et al.

(10) Patent No.: US 9,475,172 B2
(45) Date of Patent: Oct. 25, 2016

(54) ADJUSTABLE GUARD FOR POWER TOOL

(71) Applicant: Milwaukee Electric Tool Corporation, Brookfield, WI (US)

(72) Inventors: Charles K. Cooksey, Menomonee Falls, WI (US); Daryl S. Richards, Sussex, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 14/697,863

(22) Filed: Apr. 28, 2015

(65) Prior Publication Data

US 2016/0016285 A1 Jan. 21, 2016

Related U.S. Application Data

(60) Provisional application No. 62/024,848, filed on Jul. 15, 2014.

(51) Int. Cl.
*B24B 55/05* (2006.01)
*B24B 23/02* (2006.01)

(52) U.S. Cl.
CPC ..... *B24B 55/052* (2013.01); *B24B 23/028* (2013.01)

(58) Field of Classification Search
CPC ..... B24B 55/05; B24B 23/02; B24B 55/052; B24B 23/058
USPC ..... 451/358, 359, 451, 452, 454
See application file for complete search history.

(56) References Cited

U.S. PATENT DOCUMENTS

| | | | |
|---|---|---|---|
| 1,911,471 | A | 5/1933 | Sacrey |
| 2,104,436 | A | 1/1938 | Pattison et al. |
| 2,377,271 | A | 5/1945 | Schumann |
| 2,452,268 | A | 10/1948 | Schumann |
| 2,546,846 | A | 3/1951 | Atkin |
| 2,746,220 | A | 5/1956 | Thomas |
| 3,413,498 | A | 11/1968 | Bowen, III et al. |

(Continued)

FOREIGN PATENT DOCUMENTS

| | | |
|---|---|---|
| EP | 236537 | 9/1987 |
| JP | 2003246208 | 9/2003 |

OTHER PUBLICATIONS

Radnor Brand Grinder Instruction Manual, <http://airgas.com/documents/pdf/SpecSheet/N-R/RAD_Radnor/instructman%20radnorneutrix.pdf> 2010, 12 pages.

*Primary Examiner* — Robert Rose
(74) *Attorney, Agent, or Firm* — Michael Best & Friedrich LLP

(57) ABSTRACT

A power tool includes an output shaft defining a rotational axis and a housing from which the output shaft protrudes. The power tool further includes a flange at least partially surrounding the output shaft, a circumferential groove defined between the housing and the flange, and a radially inward-extending slot in the flange. The power tool also includes a rotatable guard having a first radially inward-extending projection and a plurality of apertures positioned radially about the rotational axis. The first radially inward-extending projection is receivable through the radially inward-extending slot in the flange and positioned within the groove. Furthermore, the power tool includes a lever having a detent member, and a biasing member for biasing the lever toward the rotatable guard. The detent member is receivable in one of the plurality of apertures to rotationally lock the rotatable guard relative to the housing.

20 Claims, 5 Drawing Sheets

(56) References Cited

U.S. PATENT DOCUMENTS 3,464,165 A 9/1969 Meredith
3,476,960 A 11/1969 Rees
3,574,975 A 4/1971 Liss
3,618,994 A 11/1971 Gepfert et al.
3,742,655 A 7/1973 Oliver
3,829,722 A 8/1974 Rosenthal, Jr. et al.
3,907,257 A 9/1975 Drzewiecki
3,940,818 A 3/1976 Anderson
4,130,770 A 12/1978 Wrobel
4,526,024 A 7/1985 Toti
4,574,532 A 3/1986 Häberle et al.
4,612,734 A 9/1986 Nakajima et al.
4,810,919 A 3/1989 Ponce et al.
4,920,702 A 5/1990 Kloss et al.
4,924,635 A * 5/1990 Rudolf ..... B24B 55/052 451/344
4,962,617 A 10/1990 Tilders et al.
4,976,071 A 12/1990 Stäbler
5,005,321 A * 4/1991 Barth ..... B24B 55/052 451/359
5,020,280 A 6/1991 O'Reilly
5,030,028 A 7/1991 Riviera et al.
5,076,030 A 12/1991 Schwab et al.
5,144,175 A 9/1992 Craggs
5,157,873 A 10/1992 Rudolf et al.
5,163,252 A 11/1992 Garner et al.
5,311,089 A 5/1994 Stroetgen et al.
5,315,193 A 5/1994 Kummer et al.
5,319,889 A 6/1994 Rudolf et al.
5,384,985 A 1/1995 Jacobsson
5,386,667 A * 2/1995 Hausslein ..... B24B 55/052 451/344
D368,772 S 4/1996 Liao
5,558,571 A 9/1996 Toyoshima et al.
5,601,483 A 2/1997 Rudolf et al.
5,632,578 A 5/1997 McCurry et al.
5,634,274 A 6/1997 Ohkouchi et al.
5,637,035 A * 6/1997 Yee ..... B23Q 11/08 144/251.2
5,766,062 A 6/1998 Edling
5,947,671 A 9/1999 Kanaan et al.
6,004,194 A 12/1999 Hild et al.
D421,798 S 3/2000 Liang
D423,155 S 4/2000 Paynter et al.
6,048,260 A 4/2000 Kopras
RE36,909 E 10/2000 Satos
D433,906 S 11/2000 Heun
D456,234 S 4/2002 Keller
D456,685 S 5/2002 Keller
D458,825 S 6/2002 Keller et al.
6,464,573 B1 10/2002 Keller
6,569,001 B2 5/2003 Rudolf et al.
D483,467 S 12/2003 Horng et al.
6,814,655 B2 11/2004 Hofmann
6,848,985 B2 2/2005 Lamprecht et al.
6,921,236 B2 7/2005 Rahberger
6,942,560 B2 9/2005 Hofmann
6,949,017 B2 * 9/2005 Koschel ..... B24B 55/052 451/358
D511,285 S 11/2005 Henssler
D511,824 S 11/2005 Chen et al.
7,059,947 B2 6/2006 Crover
7,077,734 B2 7/2006 Tiede
7,077,736 B2 7/2006 Uzumcu et al.
7,131,897 B2 11/2006 Crover
7,157,818 B2 1/2007 Jones
7,175,513 B2 2/2007 Folin
7,252,581 B2 8/2007 Numata et al.
7,258,173 B2 8/2007 Hammerstingl et al.
D553,933 S 10/2007 Esenwein
7,300,262 B2 11/2007 Ku et al.
D558,324 S 12/2007 Hong
7,332,838 B2 2/2008 Akiba
D574,077 S 7/2008 Horng et al.
7,510,465 B2 3/2009 Chung et al.
7,524,239 B2 4/2009 Schmidberger-Brinek et al.
7,567,001 B2 7/2009 Kasai et al.
7,719,146 B2 5/2010 Takahashi et al.
7,722,444 B2 5/2010 Gallagher et al.
7,732,955 B2 6/2010 Miller et al.
7,768,750 B2 8/2010 Uchida
7,786,627 B2 8/2010 Riedl
7,794,305 B2 9/2010 Nelson
7,892,075 B2 * 2/2011 Esenwein ..... B24B 23/028 451/344
D633,928 S 3/2011 Nilsson
D634,170 S 3/2011 Hu et al.
D634,833 S 3/2011 Stagg
7,909,680 B2 3/2011 Boeck et al.
7,927,191 B2 4/2011 Esenwein
D637,057 S 5/2011 Schomisch
7,955,162 B2 6/2011 Boeck et al.
7,988,538 B2 8/2011 Trautner et al.
D644,898 S 9/2011 Okuda
D647,772 S 11/2011 Hayakawa
D651,062 S 12/2011 Wack
D651,499 S 1/2012 Tong
D651,874 S 1/2012 Davidian
D651,875 S 1/2012 Davidian
D651,876 S 1/2012 Davidian
D651,877 S 1/2012 Davidian
D651,878 S 1/2012 Davidian
D652,274 S 1/2012 Davidian
8,087,475 B2 1/2012 Habel et al.
8,087,977 B2 1/2012 Gallagher et al.
8,096,857 B2 1/2012 Hofmann et al.
8,113,922 B2 2/2012 Esenwein
8,123,596 B2 2/2012 Kobayashi et al.
D660,119 S 5/2012 Fukumoto et al.
8,221,197 B2 7/2012 Boeck et al.
8,231,436 B2 7/2012 Boeck et al.
8,246,425 B2 8/2012 Schudel
D669,754 S 10/2012 Wackwitz
8,282,446 B2 10/2012 Sulea et al.
8,292,700 B2 10/2012 Gallagher et al.
8,425,282 B2 4/2013 Woods et al.
8,454,411 B2 6/2013 Boeck et al.
8,454,412 B2 6/2013 Esenwein
D685,240 S 7/2013 Waldron
D685,241 S 7/2013 Waldron
D694,076 S 11/2013 Davidian
D694,597 S 12/2013 Davidian
D694,598 S 12/2013 Davidian
D694,599 S 12/2013 Davidian
D697,384 S 1/2014 Wackwitz
D707,517 S 6/2014 Aglassinger
D708,031 S 7/2014 Aglassinger
D709,341 S 7/2014 Nispel
D710,170 S 8/2014 Aglassinger
D710,171 S 8/2014 Aglassinger
D715,616 S 10/2014 Aglassinger
D724,923 S 3/2015 McRoberts
D735,568 S 8/2015 Barnett
D746,118 S 12/2015 Xu
2004/0138668 A1 7/2004 Fisher
2005/0282474 A1 12/2005 Jones
2008/0153404 A1 * 6/2008 Schmidberger-Brinek B24B 55/052 451/359
2009/0179507 A1 7/2009 Tanimoto
2009/0293696 A1 12/2009 Rauscher et al.
2010/0026107 A1 2/2010 Hosokawa
2010/0056029 A1 3/2010 Grunikiewicz
2010/0102654 A1 4/2010 Lange et al.
2010/0105300 A1 4/2010 Esenwein
2010/0123359 A1 5/2010 Nishikawa
2010/0132968 A1 6/2010 Hartmann
2010/0178857 A1 7/2010 Esenwein
2010/0304648 A1 12/2010 Boeck et al.
2011/0001368 A1 1/2011 Lau
2011/0025142 A1 2/2011 Bernhardt et al.
2011/0171887 A1 7/2011 Tanimoto et al.
2011/0195643 A1 * 8/2011 Dai ..... B24B 55/05 451/359

(56) References Cited

U.S. PATENT DOCUMENTS

| | | | | |
|---|---|---|---|---|
| 2011/0241457 | A1 | 10/2011 | Müller et al. | |
| 2011/0281507 | A1 | 11/2011 | Trautner et al. | |
| 2012/0080963 | A1 | 4/2012 | Yoshikawa | |
| 2012/0184191 | A1 | 7/2012 | Schulze | |
| 2012/0231710 | A1 | 9/2012 | Boeck et al. | |
| 2012/0270480 | A1* | 10/2012 | Rohde | B23D 45/16 451/451 |
| 2013/0090045 | A1 | 4/2013 | Meyer | |

* cited by examiner

ADJUSTABLE GUARD FOR POWER TOOL

CROSS-REFERENCE TO RELATED APPLICATIONS

This application claims priority to U.S. Provisional Patent Application No. 62/024,848 filed on Jul. 15, 2014, the entire contents of which are incorporated herein by reference.

FIELD OF THE INVENTION

The present invention relates to guards for hand-held power tools, and more particularly to adjustable guards.

BACKGROUND OF THE INVENTION

Power tools, such as hand-held angle grinders, include rotating abrasive tool elements that create debris during operation on a workpiece. A guard can shield a user of the power tool from such debris created during operation. However, guards may be non-adjustable, or difficult to adjust, and may block the user's view of the workpiece.

SUMMARY OF THE INVENTION

The invention provides, in another aspect, a power tool comprising an output shaft defining a rotational axis and a housing from which the output shaft protrudes. The power tool further includes a flange at least partially surrounding the output shaft, a circumferential groove defined between the housing and the flange, and a radially inward-extending slot in the flange. The power tool also includes a rotatable guard having a first radially inward-extending projection and a plurality of apertures positioned radially about the rotational axis. The first radially inward-extending projection is receivable through the radially inward-extending slot in the flange and positioned within the groove. Furthermore, the power tool includes a lever having a detent member, and a biasing member for biasing the lever toward the rotatable guard. The detent member is receivable in one of the plurality of apertures to rotationally lock the rotatable guard relative to the housing.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
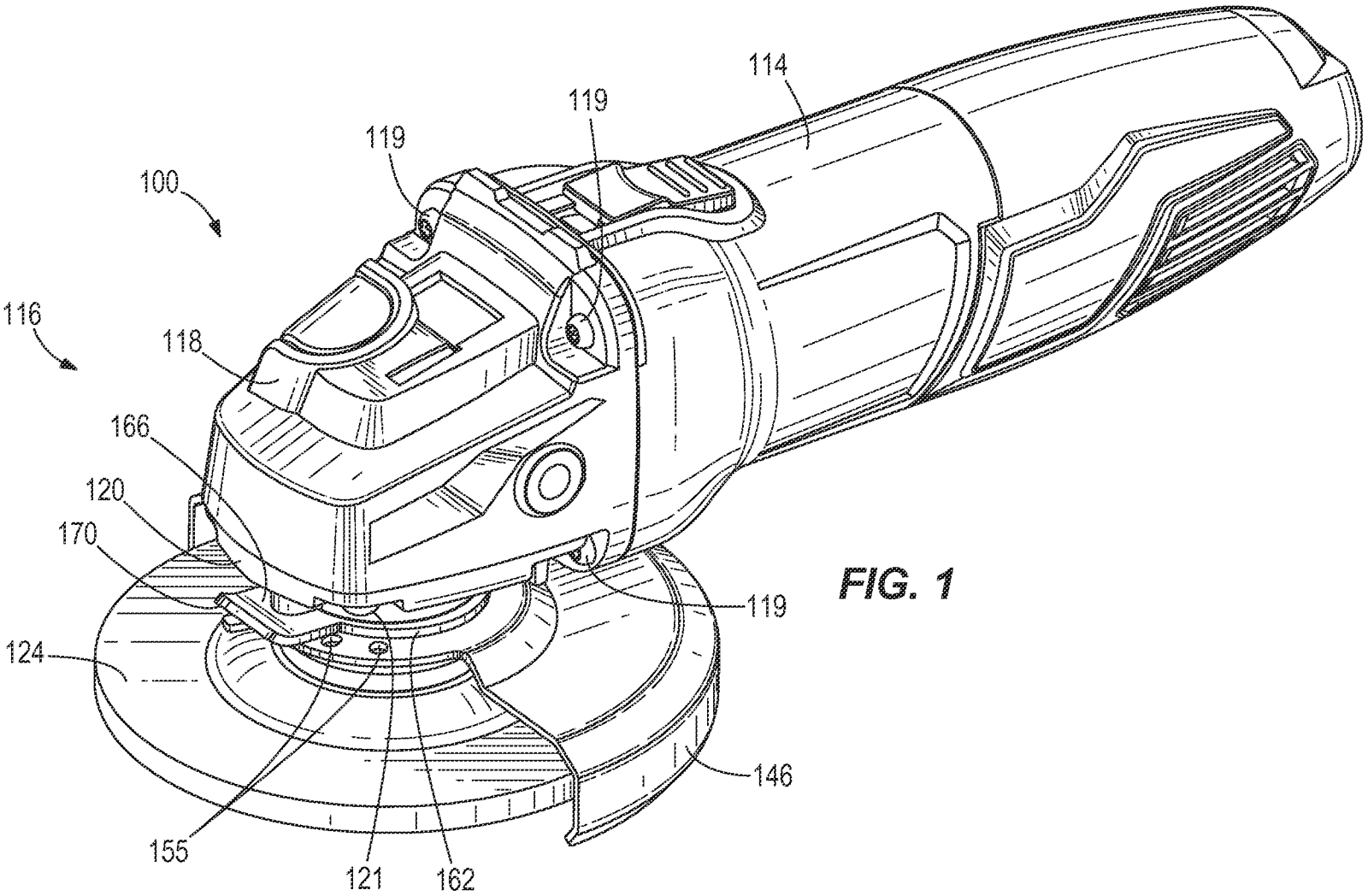
FIG. 1 is a perspective view of a power tool in accordance with an embodiment of the invention.
Figure 2:
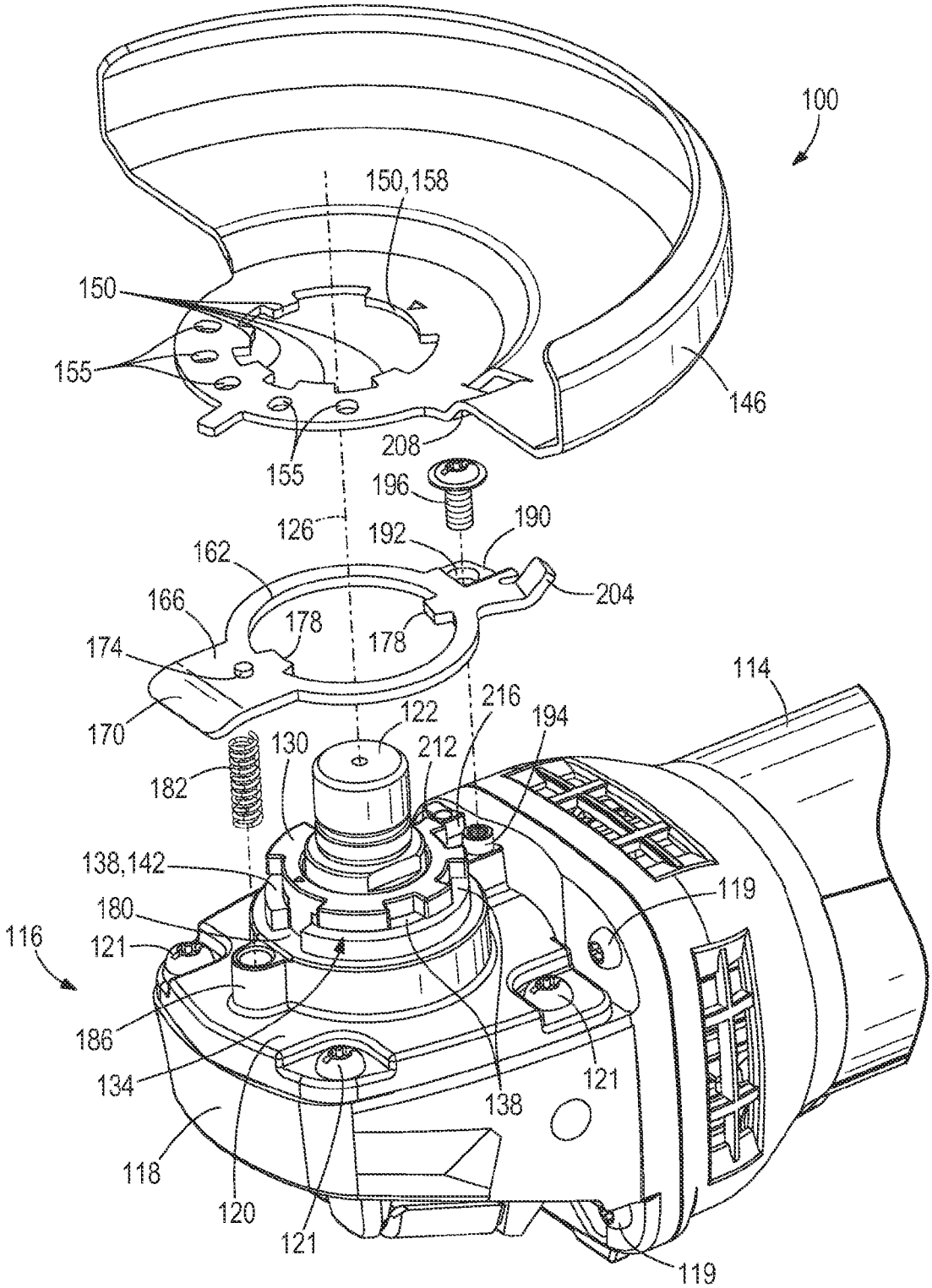
FIG. 2 is an exploded perspective view of the power tool of FIG. 1, illustrating a rotatable guard and a lever for adjusting the rotational position of the guard.

FIG. 1 illustrates a hand-held power tool 100 (i.e., an angle grinder) including a motor housing 114, a gear housing 116 having a gear case 118 and a gear case cover 120, and an output shaft 122 extending from the gear housing 116 along a rotational axis 126 (FIG. 2). The output shaft 122 is driven by a motor positioned within the motor housing 114 and a gear train positioned within the gear housing 116. The gear case 118 is secured to the motor housing 114 via fasteners 119, and the gear case cover 120 is secured to the gear case 118 via fasteners 121. A grinding disc 124 (shown only in FIG. 1) is coupled to the output shaft 122 for co-rotation therewith about the rotational axis 126.

With reference to FIG. 2, the tool 100 also includes a flange 130 extending from the gear case cover 120 and surrounding the output shaft 122. The flange 130 includes six radially inward-extending slots 138 and defines a circumferential groove 134 in conjunction with the gear case cover 120. One of the slots 138 is an enlarged slot 142 used for alignment purposes as explained in detail below. In other embodiments of the tool 100, the flange 130 may include more or fewer slots 138.

With continued reference to FIG. 2, the tool 100 further includes a removable and rotatable guard 146 for partially covering the grinding disc 124 (not shown in FIGS. 2-4E for clarity). The guard 146 includes six radially inward-extending projections 150 and five apertures 155 positioned radially about the rotational axis 126. One of the projections 150 is an enlarged projection 158, corresponding to the enlarged slot 142 on the flange 130. The projections 150 on the guard 146 are receivable through the slots 138 in the flange 130 with the enlarged projection 158 corresponding to the enlarged slot 142. The guard 146 is rotated about the rotational axis 126 to position the projections 150 within the groove 134, thereby axially securing the guard 146 to the gear housing 116. The guard 146 is thereby removable from the groove 134 only when the enlarged projection 158 aligns with the enlarged slot 142.

Referring still to FIG. 2, the tool 100 further includes a latch plate 162 for rotationally locking the guard 146 into place relative to the gear housing 116. The latch plate 162 includes a detent lever 166, an actuating portion 170, and a detent member 174. The latch plate 162 further includes two radially inward-extending tabs 178 received within axial channels 180 formed in the gear case cover 120 to properly orient the latch plate 162 between the gear case cover 120 and the guard 146 and to prevent rotation of the latch plate 162 about the axis 126. A coil spring 182 is coupled to a spring seat 186 and biases the detent lever 166 toward the rotatable guard 146. In the illustrated embodiment, the spring seat 186 is a recess and the coil spring 182 is positioned within the spring seat 186. In alternative embodiments, the spring seat may be a post and the coil spring may be positioned and seated around the post. The detent member 174 is receivable in one of the five apertures 155 in the guard 146 to rotationally lock the guard 146 relative to the gear housing 116. The detent lever 166 is biased by the spring 182 to position the detent member 174 in one of the apertures 155 in the blade guard 146 upon installation of the guard 146 onto the gear case cover 120 as described above. The detent member 174 is removed from one of the apertures 155 in the guard 146 by applying a force to the actuating portion 170 of the detent lever 166 directed away from the guard 146. The applied force displaces the detent member 174 from one of the aperture 155, after which time the guard 146 is free to rotate about the rotational axis 126 to a different rotational position relative to the gear housing 116. Upon releasing the actuating portion 170, the spring 182 biases the detent member 174 back toward the guard 146, thereby positioning the detent member 174 into the next aperture 155 that it encounters as rotation of the guard 146 continues to a desired position.

Figure 3:
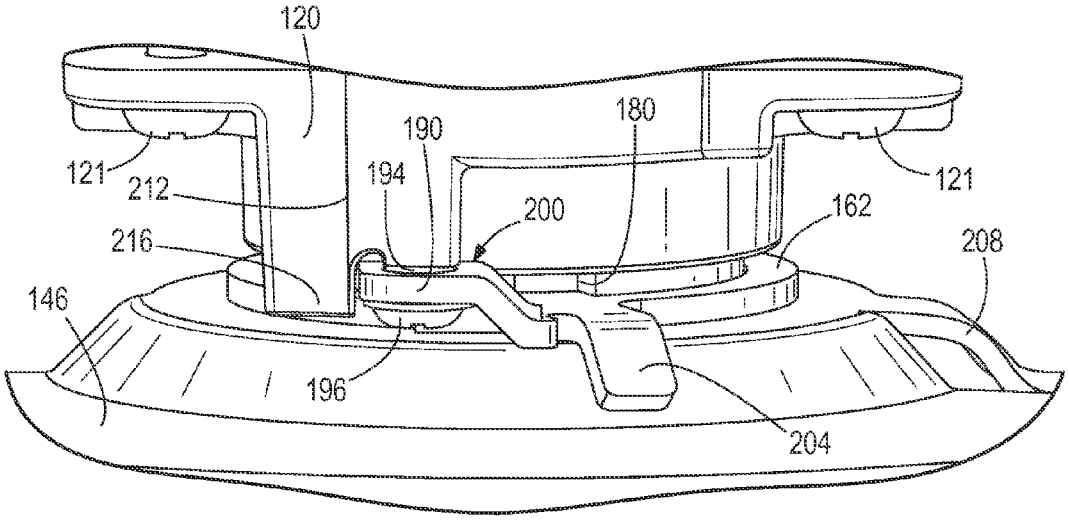
FIG. 3 is an assembled, perspective view of the power tool of FIG. 1, illustrating a final stop feature on the rotatable guard of FIG. 1.
Figure 4A:
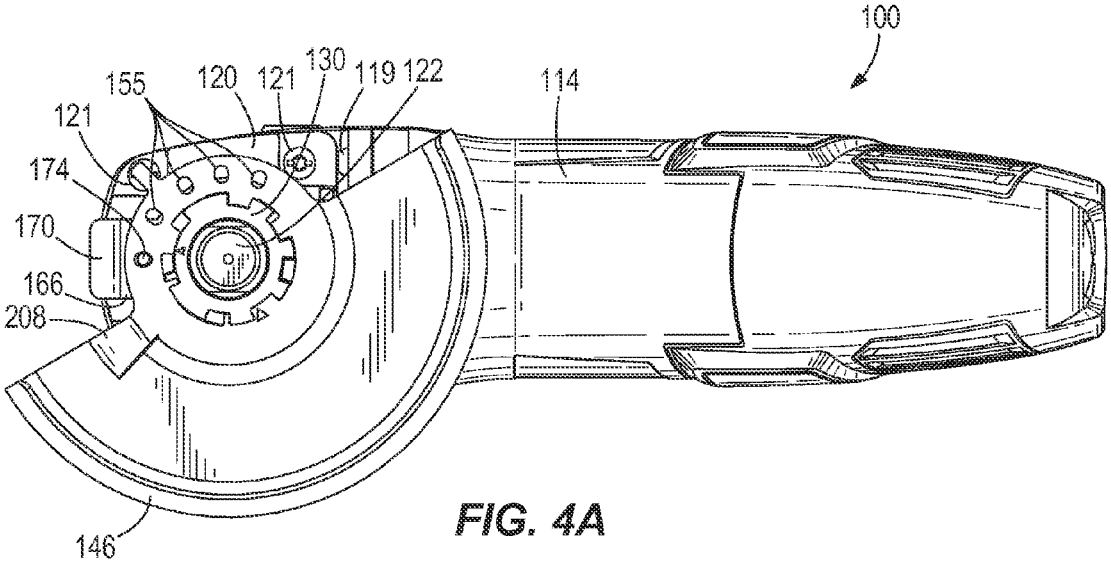
FIG. 4A is an assembled, bottom view of the power tool of FIG. 1 illustrating the rotatable guard in a first rotational position.
Figure 4B:
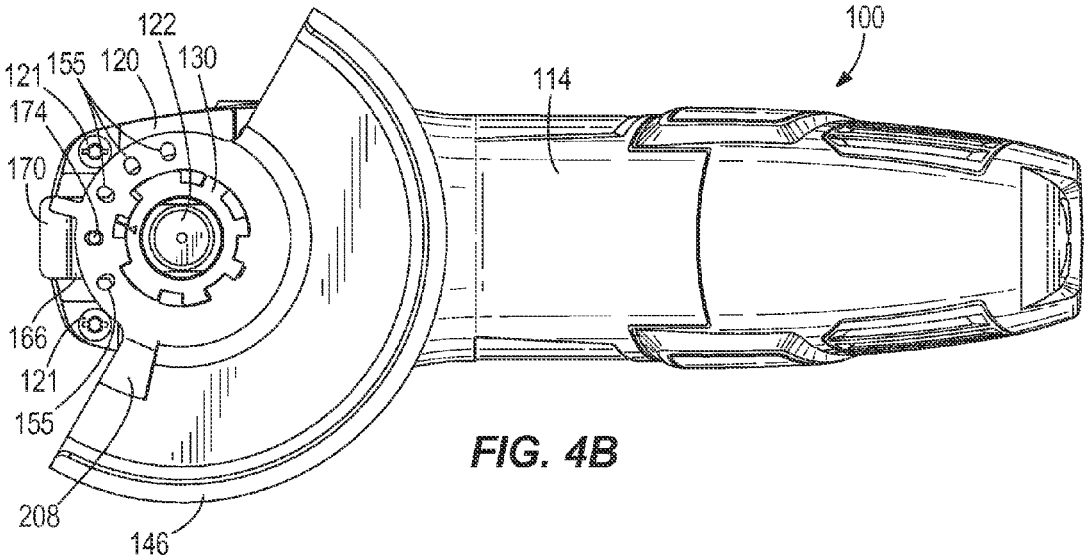
FIG. 4B is an assembled, bottom view of the power tool of FIG. 1 illustrating the rotatable guard in a second rotational position.
Figure 4C:
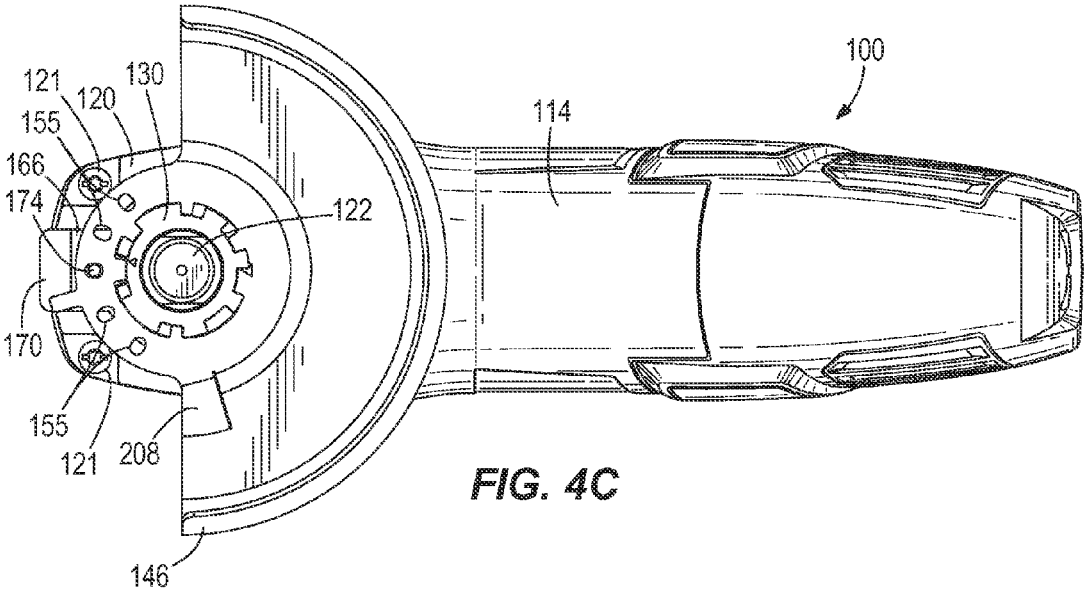
FIG. 4C is an assembled, bottom view of the power tool of FIG. 1 illustrating the rotatable guard in a third rotational position.
Figure 4D:
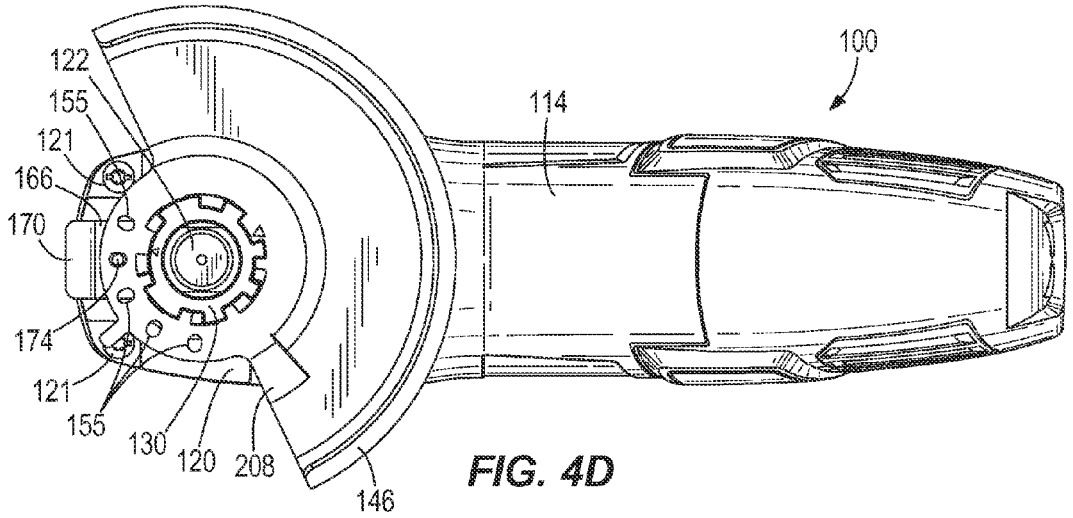
FIG. 4D is an assembled, bottom view of the power tool of FIG. 1 illustrating the rotatable guard in a fourth rotational position.
Figure 4E:
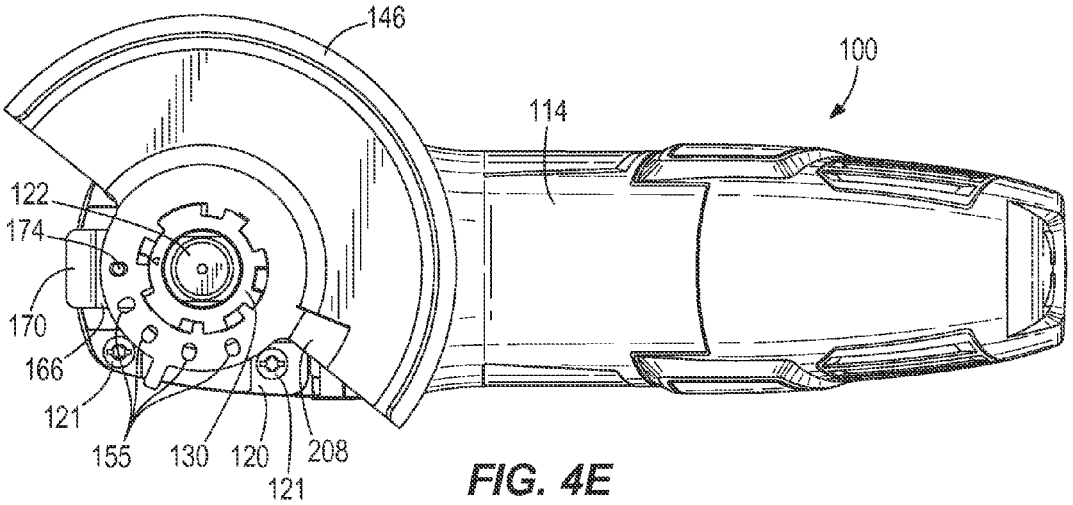
FIG. 4E is an assembled, bottom view of the power tool of FIG. 1 illustrating the rotatable guard in a fifth rotational position.

With reference to FIGS. 2 and 3, the latch plate 162 further includes a mounting tab 190 that is coupled to a boss 194 formed on the gear case cover 120. More specifically, the boss 194 is received within an aperture 192 formed in the mounting tab 190, and a fastener 196 secures the mounting tab 190 around the boss 194. The fastener 196 abuts the end of the boss 194, thereby creating a gap 200 within which the mounting tab 190 can move with respect to the boss 194. The gap 200 permits the latch plate 162 to teeter during actuation of the detent lever 166 to remove the detent member 174 from one of the apertures 155.

The latch plate 162 further includes a stop finger 204 that cooperates with a corresponding final stop projection 208 extending from an upper surface of the guard 146. The final stop projection 208 prevents over-rotation of the guard 146 regardless of whether the detent member 174 is received in one of the apertures 155. The final stop projection 208 abuts the stop finger 204 of the latch plate 162 to prevent more than a predetermined amount of rotation (e.g., 180 degrees) of the guard 146 relative to the gear housing 116 from occurring should, for example, the grinding disc 124 shatter during use of the tool 100. The gear case cover 120 includes a bulkhead 212, which provides additional reinforcement and strength to the gear case cover 120, having a bumper portion 216 for absorbing an impact between the final stop projection 208 and stop finger 204. In the illustrated embodiment, the bumper portion 216 is circumferentially adjacent the mounting tab 190 of the latch plate 162, such that any circumferential impact transferred to the latch plate 162 is absorbed by the bumper portion 216. The bumper portion 216 is positioned at least in part for preventing a complete rotation of the latch plate 162, as required by UL 60745-2-3, should the boss 194 and fastener 196 be sheared from an impact between the final stop projection 208 and the stop finger 204. In alternative embodiments, the particular features described above as formed on the gear case cover 120 (e.g., the bulkhead 212, the spring seat 186, the groove 134, etc.) may be formed on the gear case 118. In further alternative embodiments, the gear case cover 120 may be an integral component of the gear case 118. In further alternative embodiments, the gear case 118 may be integrally formed with the motor housing 114.

With reference to FIGS. 4A-4E, the rotatable guard 146 is shown rotatably locked by the latch plate 162 in five different positions, one position for each of the five apertures 155. In other words, the detent member 174 is received in a different one of the apertures 155 in each of FIGS. 4A-4E. The user selects or adjusts the position of the guard 146 by pulling upward on the actuating portion 170 (from the frame of reference of FIG. 1), rotating the guard 146 to any of the positions shown in FIGS. 4A-4E, and then releasing the latch plate 162, thereby allowing the spring 182 to again bias the detent member 174 toward the guard 146 for insertion into another of the apertures 155 corresponding with the chosen orientation of the guard 146 in any of FIGS. 4A-4E to rotationally lock the guard 146 to the gear housing 116 again.

Various features and advantages of the invention are set forth in the following claims.

What is claimed is:

1. A power tool comprising:

an output shaft defining a rotational axis;

a housing from which the output shaft protrudes;

a flange at least partially surrounding the output shaft;

a circumferential groove defined between the housing and the flange;

a radially inward-extending slot in the flange;

a rotatable guard including a first radially inward-extending projection and a plurality of apertures positioned radially about the rotational axis, the first radially inward-extending projection is receivable through the radially inward-extending slot in the flange and positioned within the groove;

a lever including a detent member; and a biasing member for biasing the lever toward the rotatable guard;

wherein the detent member is receivable in one of the plurality of apertures to rotationally lock the rotatable guard relative to the housing.

2. The power tool of claim 1, wherein the radially inward-extending slot is a first radially inward-extending slot, and wherein the power tool further includes a second radially inward-extending slot in the flange.

3. The power tool of claim 2, further including a second radially inward-extending projection on the rotatable guard.

4. The power tool of claim 3, wherein the second radially inward-extending projection is receivable through the second radially inward-extending slot in the flange and positioned within the groove.

5. The power tool of claim 4, wherein the first radially inward-extending projection is larger than the second radially inward-extending projection, and wherein the first radially inward-extending slot is larger than the second radially inward-extending slot.

6. The power tool of claim 1, wherein the rotatable guard is removable from the housing.

7. The power tool of claim 6, wherein removing the rotatable guard from the housing includes aligning the first radially inward-extending projection with the radially inward-extending slot.

8. The power tool of claim 1, wherein the biasing member is coupled to a seat formed on the housing.

9. The power tool of claim 1, further comprising a latch plate upon which the lever and the detent member are integrally formed.

10. The power tool of claim 9, wherein the latch plate circumferentially surrounds the output shaft.

11. The power tool of claim 9, wherein the latch plate further includes a radially inward-extending tab that is received within a corresponding axial channel formed in the housing.

12. The power tool of claim 9, wherein the latch plate further includes a mounting tab that is coupled to a boss formed on the housing.

13. The power tool of claim 12, wherein the mounting tab includes an aperture through which the boss is received, and wherein the power tool further includes a fastener anchored to the boss for securing the mounting tab in position around the boss.

14. The power tool of claim 13, wherein a head of the fastener abuts an end of the boss to create a gap between the fastener head and the end of the boss, and wherein the mounting tab is positioned within the gap for movement with respect to the boss.

15. The power tool of claim 14, wherein the gap permits the latch plate to teeter during actuation of the lever to remove the detent member from one of the plurality of apertures.

16. The power tool of claim 9, wherein the latch plate further includes a stop, and wherein the rotatable guard further includes a final stop projection.

17. The power tool of claim 16, wherein the stop and the final stop projection abut to prevent more than a predetermined amount of rotation of the guard with respect to the housing.

18. The power tool of claim 17, wherein the housing further includes a bumper portion operable to absorb an impact between the stop and the final stop projection.

19. The power tool of claim 18, wherein the bumper portion is circumferentially adjacent a mounting tab of the latch plate.

20. The power tool of claim 1, wherein the power tool is configured as a right-angle grinder.

* * * * *